US011976876B2

(12) United States Patent
Li et al.

(10) Patent No.: US 11,976,876 B2
(45) Date of Patent: May 7, 2024

(54) REFRIGERATOR

(71) Applicants: QINGDAO HAIER REFRIGERATOR CO., LTD., Qingdao (CN); HAIER SMART HOME CO., LTD., Qingdao (CN)

(72) Inventors: Junping Li, Qingdao (CN); Wenchao Wang, Qingdao (CN); Bing Han, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 21 days.

(21) Appl. No.: 17/799,653

(22) PCT Filed: Jul. 1, 2020

(86) PCT No.: PCT/CN2020/099746
§ 371 (c)(1),
(2) Date: Aug. 12, 2022

(87) PCT Pub. No.: WO2021/164180
PCT Pub. Date: Aug. 26, 2021

(65) Prior Publication Data

US 2023/0076386 A1 Mar. 9, 2023

(30) Foreign Application Priority Data

Feb. 21, 2020 (CN) ..... 202010108334.6

(51) Int. Cl.
*F25D 23/06* (2006.01)
*F25D 23/00* (2006.01)

(52) U.S. Cl.
CPC ..... *F25D 23/065* (2013.01); *F25D 23/006* (2013.01)

(58) Field of Classification Search
CPC .... F25D 23/065; F25D 23/006; F25D 23/062; F25D 23/063; F25D 23/067
See application file for complete search history.

(56) References Cited

U.S. PATENT DOCUMENTS 5,727,859 A * 3/1998 Jeong ..... F25D 23/006 312/407.1
2004/0221611 A1* 11/2004 Shin ..... F25D 23/003 62/507

(Continued)

FOREIGN PATENT DOCUMENTS

CN 201811524 U 4/2011
CN 104764279 A 7/2015

(Continued)

OTHER PUBLICATIONS

English translation of CN104764279A from espacenet (Year: 2023).*

*Primary Examiner* — Daniel J Rohrhoff
(74) *Attorney, Agent, or Firm* — Cheng-Ju Chiang

(57) ABSTRACT

A refrigerator, including a box body having a rear shell, a compressor compartment disposed below the box body, and a rear cover plate covering the rear side of the compressor compartment, wherein the rear cover plate is adjacently disposed below the rear shell; the rear shell has a rear back plate and a fixing structure bending forwards from the lower end of the rear back plate; the rear cover plate has a cover plate main body and a butt-joint structure bending forwards from the top of the cover plate main body; and clamping mechanisms matching each other for spacing are disposed on the fixing structure and the butt-joint structure. According to the foregoing arrangement, it can be ensured that no vertical gap can be formed between the rear cover plate and the upper side of the rear back plate of the refrigerator.

11 Claims, 7 Drawing Sheets

(56) References Cited

U.S. PATENT DOCUMENTS

| | | | | |
|---|---|---|---|---|
| 2005/0160760 | A1* | 7/2005 | Chae | F25D 23/006 62/507 |
| 2007/0095094 | A1* | 5/2007 | Lucas | E04H 5/10 62/440 |
| 2015/0153097 | A1* | 6/2015 | Koo | F25D 23/003 62/428 |
| 2020/0141629 | A1* | 5/2020 | Seo | F25D 23/067 |
| 2020/0200467 | A1* | 6/2020 | Park | F25D 19/00 |
| 2021/0199366 | A1* | 7/2021 | Gochika | F25D 23/006 |
| 2021/0404729 | A1* | 12/2021 | Yoo | F28D 1/0476 |
| 2022/0090830 | A1* | 3/2022 | Sung | F28F 9/0212 |
| 2022/0252331 | A1* | 8/2022 | Kim | F25D 23/06 |
| 2023/0288131 | A1* | 9/2023 | Lee | F25D 23/062 312/401 |

FOREIGN PATENT DOCUMENTS

| | | | |
|---|---|---|---|
| CN | 107477958 | A | 12/2017 |
| CN | 208382701 | U | 1/2019 |
| CN | 109916128 | A | 6/2019 |
| CN | 111121379 | A | 5/2020 |
| JP | 2002-267353 | A | 9/2002 |

* cited by examiner

REFRIGERATOR

CROSS REFERENCE TO RELATED APPLICATIONS

The present invention is a 35 U.S.C. § 371 National Phase conversion of International (PCT) Patent Application No. PCT/CN2020/099746, filed on Jul. 1, 2020, which claims benefit of Chinese Application No. 202010108334.6, filed on Feb. 21, 2020, the disclosure of which is incorporated by reference herein. The PCT International Patent Application was filed and published in Chinese.

TECHNICAL FIELD

The present invention relates to the cooling field of refrigerators, and in particular, to a refrigerator in which a gap between a rear back plate and a rear cover plate is reduced.

BACKGROUND

A rear cover plate of a compressor compartment of an existing refrigerator is fixedly connected to a rear back plate of the refrigerator by bolts or snaps, that is, the rear cover plate of the compressor compartment is in forward-backward press fit and connection with the rear back plate of the refrigerator. Therefore, an upward gap exists between the rear cover plate of the compressor compartment and the rear back plate of the refrigerator. When the refrigerator deforms after foaming or its component has a difference, the gap between the rear cover plate of the compressor compartment and the rear back plate of the refrigerator not only adversely affects the appearance, but also makes the outside directly communicated with the compressor compartment, which is likely to cause damp in the compressor compartment.

SUMMARY

The present invention provides a refrigerator capable of avoiding an adverse impact of a vertical slit between the upper side of a rear cover plate of a compressor compartment on the rear side of the refrigerator and a housing of the refrigerator on the appearance of the refrigerator.

To implement the above objective, the technical solution of the present invention is described as below.

A refrigerator, comprising a box body having a rear shell, a compressor compartment disposed below the box body, and a rear cover plate covering a rear side of the compressor compartment, wherein the rear cover plate is adjacently disposed below the rear shell; the rear shell has a rear back plate and a fixing structure formed by bending forwards from a lower end of the rear back plate; the rear cover plate has a cover plate main body and a butt-joint structure formed by bending forwards from a top of the cover plate main body; and the fixing structure and the butt-joint structure are provided with clamping mechanisms that cooperates with each other to limit the position.

Further, wherein an entirety of the fixing structure takes the shape of U having a backward opening; and the butt-joint structure takes the shape of a plate and extends into the U-shaped fixing structure.

Further, wherein the fixing structure has a first wall bending forwards from a lower end of the rear shell, a second wall bending downwards from a front end of the first wall, and a third wall bending and extending backwards from a lower end of the second wall; and the clamping mechanisms are disposed between the third wall and the butt-joint structure.

Further, wherein the butt-joint structure is an extending wall extending forwards from a top end of the cover plate main body towards the second wall; the clamping mechanisms are latching pieces respectively formed by tearing the third wall and the extending wall; and the latching piece on the third wall and the latching piece on the extending wall extend towards each other and latch each other.

Further, wherein the clamping mechanisms are a latching convex and a latching groove respectively disposed on the fixing structure and the butt-joint structure; and a side, facing the latching groove, of the latching convex extends slantly from rear to front.

Further, wherein the box body has lateral shells disposed on two sides of the compressor compartment and reinforcers fixed with the lateral shells; each reinforcer is disposed on an inner side at a rear end of the lateral shell; and plug-in mechanisms in spacing fit with each other are also disposed between two sides of the rear cover plate and the reinforcer.

Further, wherein the plug-in mechanism has a plug-in piece disposed on one of the rear cover plate and the reinforcer and a clamping portion disposed on the other one of the rear cover plate and the reinforcer; the plug-in piece is formed via tearing and extends from top to bottom; the clamping portion extends horizontally; and a slot is formed between the clamping portion, and the rear cover plate or a main body structure of the reinforcer on which the clamping portion is disposed, so that the plug-in piece is plugged in downwards.

Further, wherein the plug-in piece is disposed in the shape of S from top to bottom.

Further, wherein the plug-in mechanism is disposed proximal to the rear cover plate and a lower end of the reinforcer.

Further, wherein several groups of clamping mechanisms are disposed horizontally at intervals, and are all disposed horizontally between the plug-in mechanisms.

Compared with the prior art, the present invention has the following beneficial effects. Since a fixing structure is arranged at the lower end of a rear back plate of a box body of the refrigerator, a butt-joint structure is arranged at the top of a main body of a rear cover plate, and clamping mechanisms match each other for spacing, wherein both the fixing structure and the butt-joint structure are formed by bending and extending components forwards, it is ensured that no vertical gap can be formed between the rear back plate of the refrigerator and the upper side of the rear cover plate of the compressor compartment, and that a portion where a gap is formed after fixing of a bent position has a low possibility of deforming. Thus, the refrigerator is more beautiful, a mounting form of the refrigerator is simplified, and the production efficiency is improved.

In which, 10—box body, 20—rear shell, 21—rear back plate, 22—fixing structure, 221—first wall, 222—second wall, 223—third wall, 30—compressor compartment, 40—rear cover plate, 41—cover plate main body, 42—butt-joint structure, 421—extending wall extending wall, 50—lateral shells, 51—housing, 52—reinforcing side plate, 60—reinforcers, 61—reinforcer base body, 62—turnups, 70—clamping mechanisms, 71—latching pieces, 80—plug-in mechanisms, 81—plug-in piece, 82—clamping portion, 821—slot, 90—cabin partitions.

DETAILED DESCRIPTION

In order to make a person skilled in the art better understand the solutions of the present invention, the technical solutions in the embodiments of the present invention will be clearly and completely described below with reference to the accompanying drawings in the embodiments of the present invention. Obviously, the embodiments described are merely some but not all embodiments of the present invention. Based on the embodiments of the present invention, all other embodiments derived by a person of ordinary skill in the art without creative efforts shall fall within the protection scope of the present invention.

In each figure of the present invention, to facilitate illustration, sizes of some structures or parts may be exaggerated relative to those of other structures or parts. Therefore, the figures are merely used for showing the basic structure of the subject of the present invention.

It should be noted that orientation or position relationships indicated by terms such as "upper", "lower", "front", and "rear" are orientation or position relationships based on the accompanying drawings, and are to facilitate and simplify description of the present invention only, rather than indicating or implying that the apparatus or element referred to must have a particular orientation or be constructed and operated in a particular orientation, so that they cannot be interpreted as limiting the present invention. Specifically, in the present invention, a user is used for reference, an end proximal to the user is "front", an end distal from the user is "rear", all other directions such as "upper" and "lower" are defined by taking "front" for reference.

Figure 1:
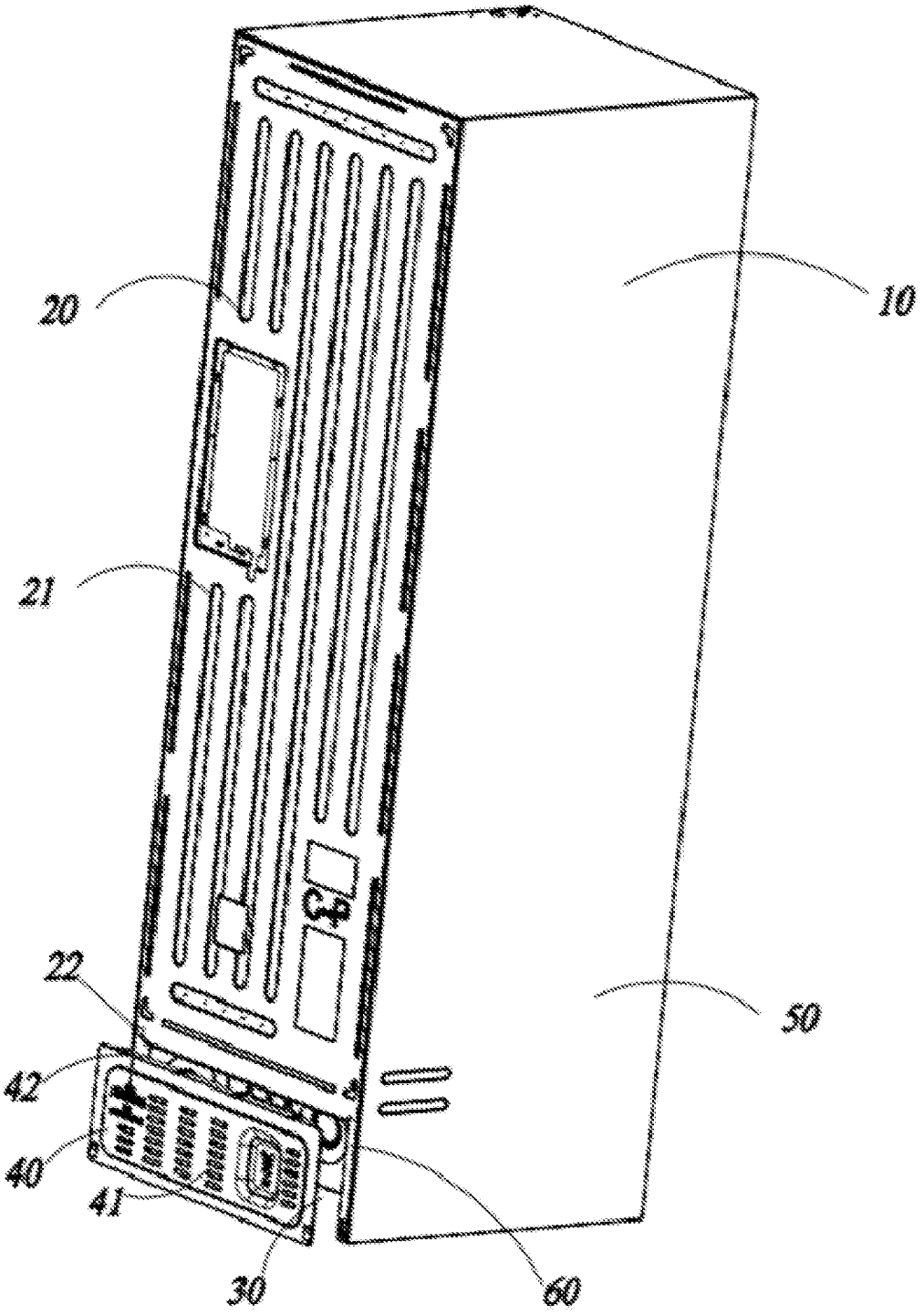
FIG. 1 is a schematic structural diagram of a connection mode between a rear cover plate and a rear back plate in an embodiment of a refrigerator according to the present invention.
Figure 2:
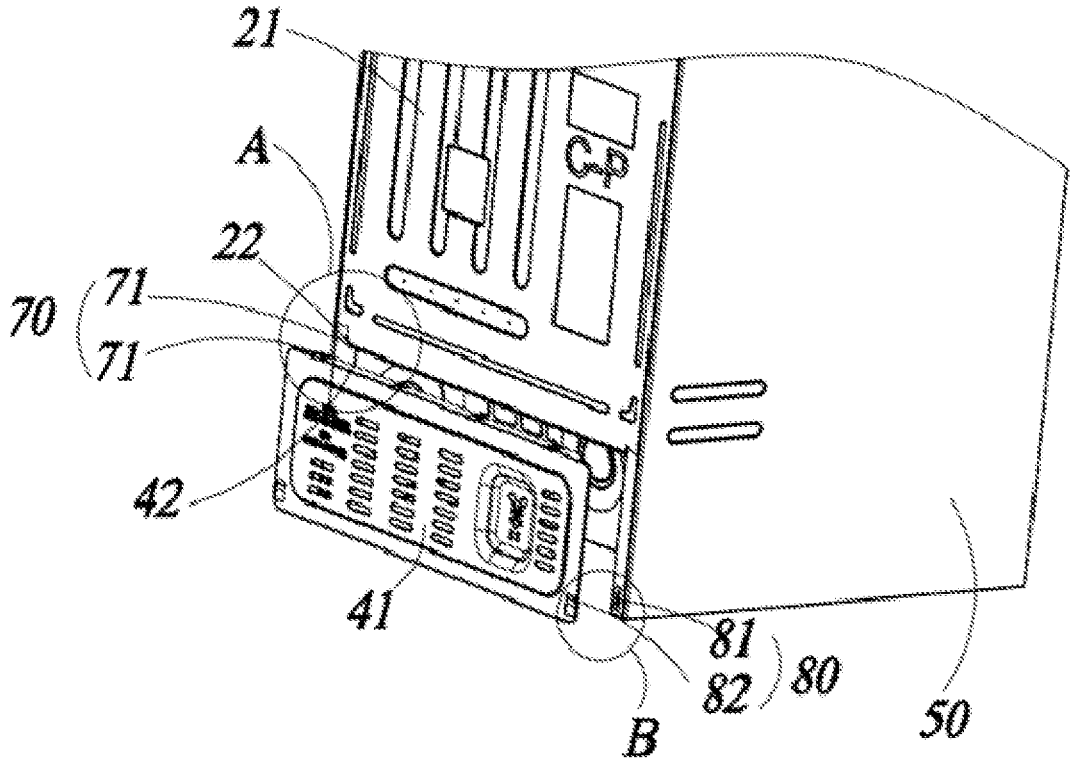
FIG. 2 is an enlarged schematic diagram of a local structure of the refrigerator in FIG. 1.
Figure 3:
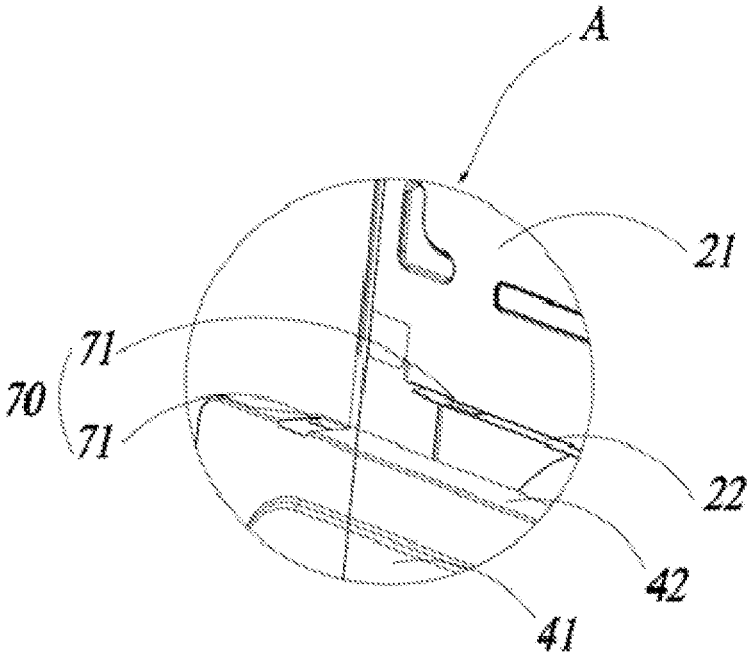
FIG. 3 is an enlarged schematic structural diagram of position A in the schematic diagram of the local structure of the refrigerator in FIG. 2.
Figure 4:
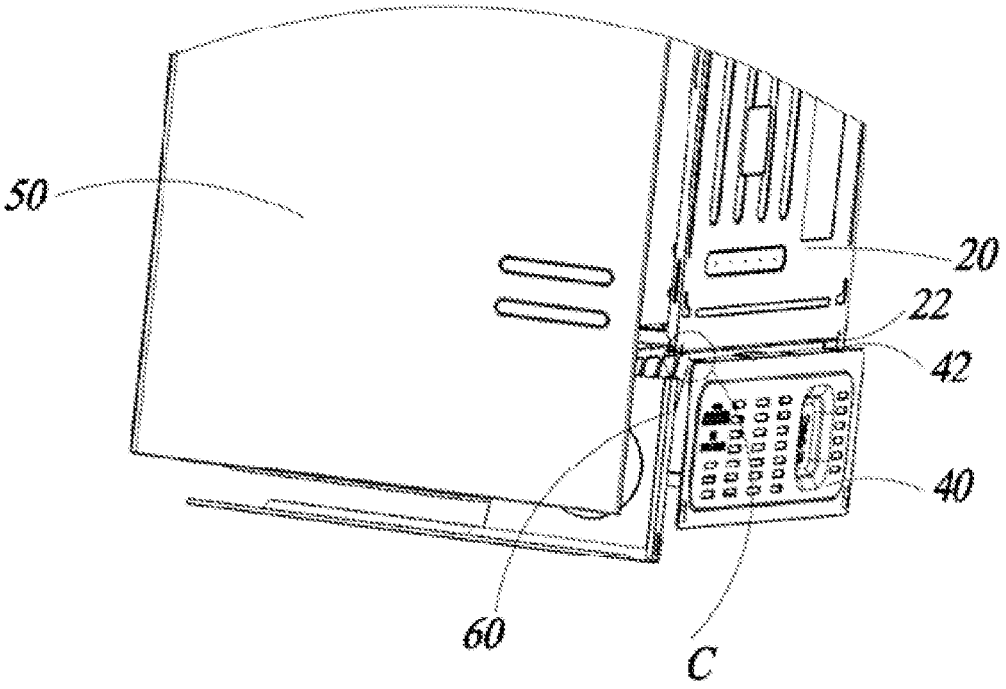
FIG. 4 is an enlarged schematic diagram of the local structure in FIG. 2 at another viewing angle.

The present invention provides a refrigerator. As shown in FIG. 1, the refrigerator includes a box body 10 having a rear shell 20, a compressor compartment 30 disposed below the box body 10, and a rear cover plate 40 covering the rear side of the compressor compartment 30, wherein the rear cover plate 40 is adjacently disposed below the rear shell 20.

Specifically, the rear shell 20 is disposed on the back of the box body 10; the compressor compartment 30 is disposed on the lower front side of the rear shell 20; a compressor is accommodated in the compressor compartment 30. The rear cover plate 40 covers a backward opening of the compressor compartment 30, that is, the rear cover plate 40 and the box body 10 are in matching fit with each other to form the compressor compartment 30, thereby protecting the compressor and a circuit therein from being damaged. It should be understood that the position of the compressor compartment 30 is not limited to the position below the box body 10. Instead, the position of the compressor compartment 30 relative to the box body 10 is adjusted appropriately based on the position of the compressor in the refrigerator, thereby accordingly changing the position of the rear cover plate 40 relative to the rear shell 20. All these positions shall fall within the protection scope of the present invention.

As a preferred embodiment of the present invention, as shown in FIG. 1, the rear shell 20 has a rear back plate 21 and a fixing structure 22 formed by bending forwards from the lower end of the rear back plate 21. Accordingly, the rear cover plate 40 has a cover plate main body 41 and a butt-joint structure 42 formed by bending forwards from the top of the cover plate main body 41; and the fixing structure 22 and the butt-joint structure 42 are provided with clamping mechanisms 70 that cooperates with each other to limit the position.

Certainly, the fixing structure 22 may also be disposed at the top end of the cover plate main body 41. Accordingly, the butt-joint structure 42 is disposed at the lower end of the rear back plate 21. The positions of the butt-joint structure 42 and the rear back plate 21 do not affect a connection relationship therebetween, and can also achieve the objective of the present invention. The present invention is mainly described by using an example in which the fixing structure 22 is disposed on the rear back plate 21 and the butt-joint structure 42 is disposed on the rear cover plate 40. There are no limitations to an included angle between the fixing structure 22 and the rear back plate 21 of the refrigerator and an included angle between the butt-joint structure 42 and the rear back plate 21 of the refrigerator. To facilitate operation, preferably, the included angle between the fixing structure 22 and the rear back plate 21 and the included angle between the butt-joint structure 42 and the rear back plate 21 are right angles.

Preferably, the fixing structure 22 and the rear back plate 21 are formed integrally, which reduces connections between parts and further makes the rear cover plate 40 and the rear back plate 21 fitted and connected tightly to reduce a gap at a joint.

Preferably, in this embodiment, the fixing structure 22 is bent integrally to take the shape of U having a backward opening. Specifically, as shown in FIGS. 2 to 5, the fixing structure 22 has a first wall 221 bending forwards from the lower end of the rear shell 20, a second wall 222 bending downwards from the front end of the first wall 221, and a third wall 223 bending and extending backwards from the lower end of the second wall 222. Accordingly, the butt-joint structure 42 is an extending wall 421 extending forwards from the top end of the cover plate main body 41 towards the second wall 222; and the extending direction of the extending wall 421 is consistent with the bending direction of the first wall 221. That is, the butt-joint structure 42 takes the shape of a plate and extends into the U-shaped fixing structure 22. In other words, the clamping mechanism 70 is disposed between the third wall 223 and the butt-joint structure 42.

According to this arrangement, in one aspect, the upper side of the rear cover plate 40 of the compressor compartment 30 and the rear shell 20 of the box body 10 are in vertical butt joint with each other, which avoids a vertical slit having an outward opening. In addition, a portion where a gap is formed after fixing of a bent position has a low possibility of deforming, so that the appearance of the refrigerator is more beautiful, a mounting form of the refrigerator is simplified, and the production efficiency is improved. In another aspect, setting the fixing structure 22 to U having a backward opening in this embodiment can not only make the rear cover plate 40 and the rear back plate 21 be connected more firmly to avoid a hidden danger that the rear cover plate 40 warps or even falls off during transportation or usage of the refrigerator, but also prevent, from being formed between the rear cover plate 40 and the rear back plate 21, a horizontal gap that exposes a backward opening of the compressor compartment 30. In other words, the second wall 222 can withstand damp from the gap, and prevent moisture from entering an interior of the compressor compartment 30, thereby guaranteeing normal operation of the compressor, and prolonging the service life of the refrigerator.

Figure 5:
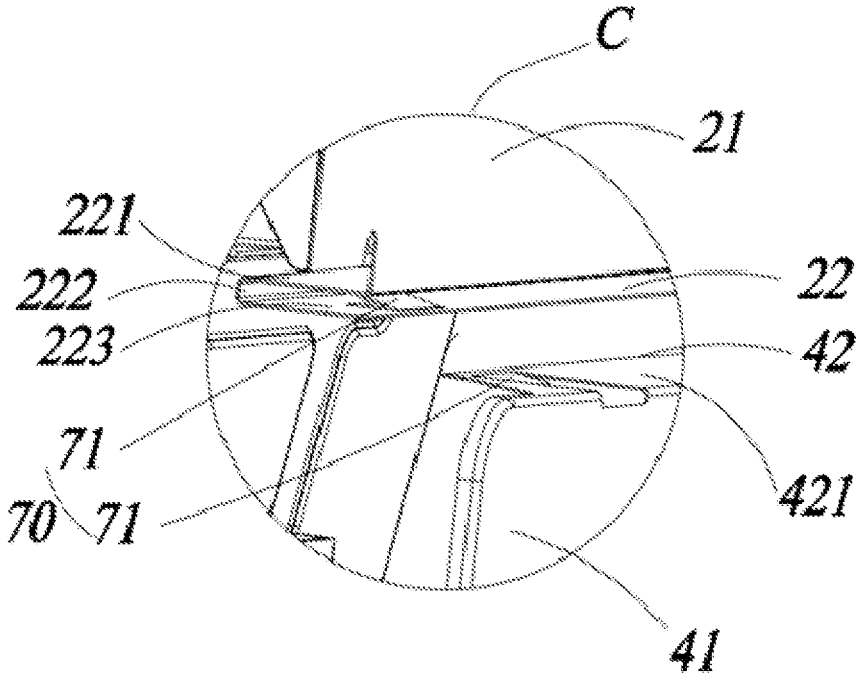
FIG. 5 is an enlarged schematic structural diagram of position C in FIG. 4.

Preferably, as shown in FIG. 5, the clamping mechanisms 70 are latching pieces 71 respectively formed by tearing the third wall 223 and the extending wall 421; and the latching piece 71 on the third wall 223 is integrally formed by tearing the third wall 223 upwards and forwards. In other words, the latching piece 71 originally belongs to the third wall 223; and after the latching piece 71 is formed, a corresponding position on the third wall 223 is hollowed out. Accordingly, the latching piece 71 on the extending wall 421 is integrally formed by tearing downwards and backwards a position, corresponding to the latching piece 71 on the third wall 223, on the lower surface of the extending wall 421. Similarly, a corresponding position on the extending wall 421 is hollowed out. In other words, the two latching pieces 71 in the clamping mechanism 70 are disposed in opposite directions, that is, the latching piece 71 on the third wall 223 and the latching piece 71 on the extending wall 421 extend towards each other and latch each other.

In an actual operation process of covering the rear cover plate 40 and the rear back plate 21 with each other, the extending wall 421 of the butt-joint structure 42 extends into the U-shaped fixing structure 22. Accordingly, when the two latching pieces 71 in the clamping mechanism 70 extend towards each other and abut on each other at positions exceeding edges of the latching pieces 71, the two latching pieces 71 latch each other, which enhances connection firmness between the rear cover plate 40 and the rear back plate 21. In addition, the rear cover plate 40 and the rear back plate 21 are in direct plug-in connection with each other, which not only simplifies the production process, but also improves the product quality.

As another preferred embodiment, the clamping mechanism 70 may also be disposed between the first wall 221 and the butt-joint structure 42. That is, one latching piece 71 is formed by tearing the upper surface of the extending wall 421 upwards and backwards, and the other latching piece 71 extends and is formed downwards and forwards by tearing the surface, facing the third wall 223, of the first wall 221. In other words, the latching piece 71 on the first wall 221 and the latching piece 71 on the upper surface of the extending wall 421 extend towards each other and latch each other. A position where the clamping mechanism 70 is disposed does not affect the effect of connection between the fixing structure 22 and the butt-joint structure 42.

As another preferred embodiment of the present invention, the clamping mechanisms 70 may also be a latching convex and a latching groove (not shown in the figures) respectively disposed on the fixing structure 22 and the butt-joint structure 42; and the side, facing the latching groove, of the latching convex extends slantly from rear to front.

Specifically, the latching convex may be disposed on the first wall 221 of the fixing structure 22, faces the upper surface of the extending wall 421 of the butt-joint structure 42, and extends slantly from rear to front; and the latching groove is disposed at a corresponding position on the upper surface of the extending wall 421. Similarly, the latching convex may also be disposed on the third wall 223 of the fixing structure 22, faces the lower surface of the extending wall 421 of the butt-joint structure 42, and extends slantly from rear to front; and the latching groove is disposed at a corresponding position on the lower surface of the extending wall 421.

Certainly, positions of the latching convex and the latching groove may be exchanged. In other words, the latching convex may be disposed on the upper surface of the extending wall 421 and extends slantly from front to rear towards the first wall 221, or disposed on the lower surface of the extending wall 421 and extends slantly from front to rear towards the third wall 223. Accordingly, the latching groove is disposed at the position, corresponding to the latching convex, on the first wall 221 or the third wall 223 of the fixing structure 22.

As another preferred embodiment of the present invention, the fixing structure 22 is not necessarily U-shaped, and may also be a bent wall directly formed by bending and extending forwards from the bottom of the rear back plate 21. The bent wall is disposed parallel to the extending wall 421 of the butt-joint structure 42. The clamping mechanism 70 is disposed between the bent wall and the extending wall 421. Specifically, the clamping mechanisms 70 may be a latching convex disposed on the bent wall and a latching groove disposed on the extending wall 421. The latching convex extends slantly from rear to front towards a side of the latching groove. Similarly, the clamping mechanisms 70 may also be a latching convex disposed on the extending wall 421 and a latching groove disposed on the bent wall. The latching convex extends slantly from front to rear towards a side of the latching groove, so that the latching groove latches the latching convex conveniently.

It should be noted that, the latching convex may be equivalent to the latching piece 71 in this embodiment of the present invention, or a wedge-shaped protrusion directly protruding from any bent wall. Connection between the latching convex and the latching groove not only changes a fixing mode of the interior of the clamping mechanism 70, but also reduces a gap between the rear cover plate 40 and the rear back plate 21.

Preferably, there are a plurality of groups of clamping mechanisms 70 disposed horizontally at intervals, so that stress at each joint during connection between the fixing structure 22 and the butt-joint structure 42 is balanced. Thus, the gap between the rear cover plate 40 and the rear back plate 21 is integrally uniform, which increases the entire beautiful degree of the refrigerator.

As another preferred embodiment of the present invention, the box body 10 has lateral shells 50 disposed on two sides of the compressor compartment 30, reinforcers 60 fixed with the lateral shells 50, and cabin partitions 90 disposed on the top side and the front side of the compressor compartment 30.

Specifically, the lateral shell 50 has a housing 51, and a reinforcing side plate 52 matching the housing 51, the cabin partition 90, and the reinforcer 60. The reinforcing side plate 52 is disposed parallel to the inner side of the housing 51. An entirety of the reinforcer 60 is L-shaped, and is in fixed fit with the lower side and the rear side of the lateral shell 50 of the refrigerator.

The reinforcer 60 includes a reinforcer base body 61 and turnups 62 formed by bending, towards the lateral shell 50 of the refrigerator, edges at two ends in the width direction of the reinforcer base body 61. The rear side and the lower side of the reinforcer 60 are respectively connected to a base plate of the refrigerator and the rear cover plate 40.

Figure 6:
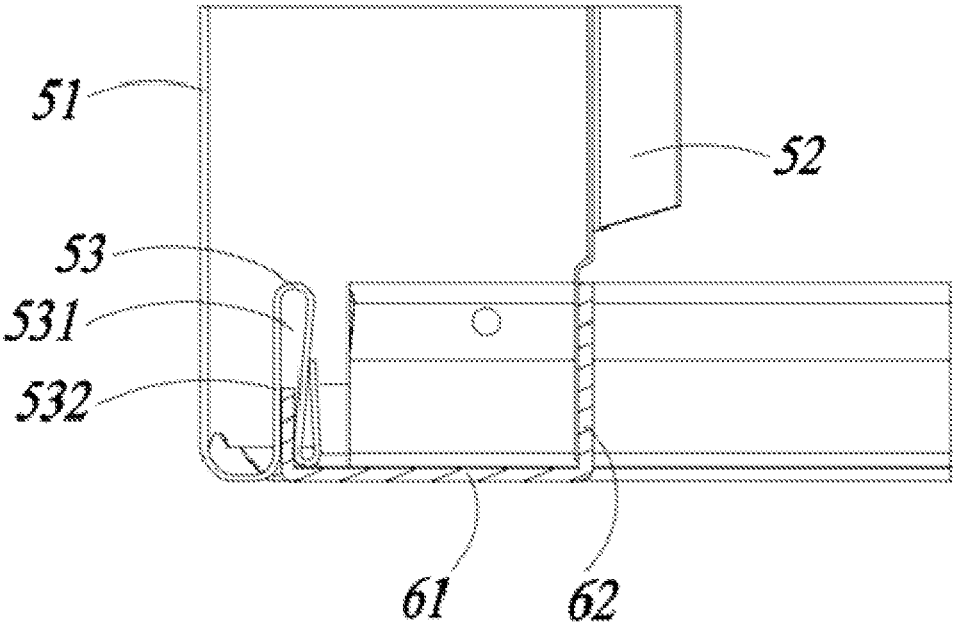
FIG. 6 is an enlarged schematic structural diagram of position B in the schematic diagram of the local structure of the refrigerator in FIG. 2.

Specifically, as shown in FIG. 6, the turnups 62 on two sides and the reinforcer base body 61 form a U-shaped structure. The turnup 62 on the inner side is connected to the lower end and the rear end of the reinforcing side plate 52. Preferably, the lower end and the rear end of the reinforcing side plate 52 are separately disposed in the U-shaped structure formed by the reinforcer base body 61 and in tight fit with the turnup 62 on the inner side.

Further, the turnup 62 on the outer side of the reinforcer 60 is connected to the lower end and the rear end of the housing 51. That is, the reinforcer 60 is disposed on the inner side at the rear end of the housing 51. A clamping structure 53 that takes the shape of Chinese character "gong" and that bends and extends towards the interior of the refrigerator is disposed at the end, adjacent to the reinforcer 60, of the housing 51. The clamping structure 53 is provided with a middle clamping groove 531 having an opening facing the reinforcer base body 61, and gripping arms 532 disposed on two sides of the middle clamping groove 531. Distances between the gripping arms 532 become smaller in the direction towards the opening of the middle clamping groove 531. The turnup 62 on the outer side of the reinforcer 60 is inserted into the clamping groove 531, and is gripped by the gripping arms 532 on two sides. The refrigerator lateral shell 50, the reinforcing side plate 52 and the reinforcer 60 define a confined space to further prevent moisture from entering the compressor compartment 30, so that leakage of a foaming fluid is prevented in a foaming process, thereby improving the product quality.

Figure 7:
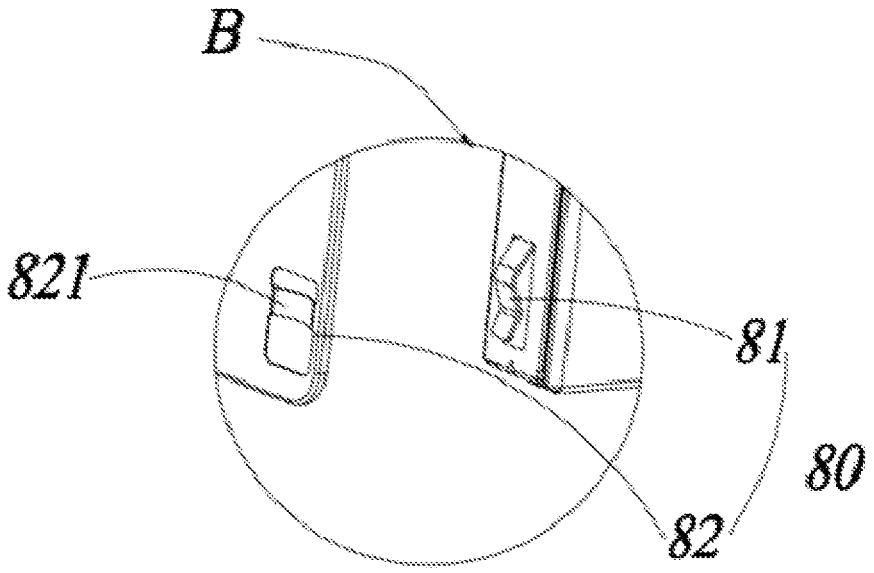
FIG. 7 is a schematic diagram of a connection structure between a lateral shell and a reinforcer of a refrigerator according to the present invention.

The rear surface of the reinforcer 60 is in fitted connection with two sides of the rear cover plate 40. As shown in FIG. 7, plug-in mechanisms 80 in spacing fit with each other are also disposed between two sides of the rear cover plate 40 and the reinforcer 60. That is, two plug-in mechanisms 80 are respectively disposed on the left side between the rear cover plate 40 and the reinforcer 60 and on the right side between the rear cover plate 40 and the reinforcer 60.

Preferably, the plug-in mechanism 80 is disposed proximal to the lower end of the rear cover plate 40 and the lower end on the back side of the reinforcer 60. That is, the plug-in mechanism 80 is disposed at the end distal from the clamping mechanism 70. The two plug-in mechanisms 80 and several groups of clamping mechanisms 70 define a fixed connection mode with a lower plug-in portion and an upper clamping portion, to stably and firmly fix the rear cover plate 40 and the box body 10 together, thereby avoiding a hidden danger that a gap becomes larger or even the rear cover plate 40 falls off due to impact on the rear cover plate 40 during transportation of the refrigerator.

Specifically, several groups of clamping mechanisms 70 are all horizontally disposed between the plug-in mechanisms 80. The two plug-in mechanisms 80 are respectively disposed at edge positions on the left side and the right side relative to a same horizontal position at the lower end of the rear cover plate 40. The clamping mechanisms 70 are disposed at non-edge positions of the fixing structure 22 and the butt-joint structure 42. When there is one clamping mechanism 70, the two plug-in mechanisms 80 and the clamping mechanism 70 form a stable three-point fixed form, which makes connection between the rear cover plate 40 and the box body 10 firmer. When there are at least two clamping mechanisms 70, the two plug-in mechanisms 80 and the several clamping mechanisms 70 form a trapezoidal fixed form, a line between the plug-in mechanism 80 and the clamping mechanism 70 is an oblique line, and stress on a joint of the plug-in mechanism 80 or the clamping mechanism 70 is resolved in a plurality of directions to balance the stress, thereby enhancing uniformity of the gap between the rear cover plate 40 and the rear back plate 21, and improving the entire beautiful degree of the refrigerator.

The plug-in mechanism 80 has a plug-in piece 81 disposed on one of the rear cover plate 40 and the reinforcer 60 and a clamping portion 82 disposed on the other one of the rear cover plate 40 and the reinforcer 60. The plug-in piece 81 and the clamping portion 82 are plugged in and fixed with each other. In other words, the plug-in mechanism 80 may be the plug-in piece 81 disposed on the rear cover plate 40. Accordingly, the clamping portion 82 is disposed at the position, corresponding to the plug-in piece, of the reinforcer 60. Similarly, the plug-in mechanism 80 may also be the plug-in piece 81 disposed in the reinforcer 60. Accordingly, the clamping portion 82 is disposed at the position, corresponding to the plug-in piece, of the rear cover plate 40.

Further, the plug-in piece 81 is formed via tearing and extends from top to bottom; the clamping portion 82 extends horizontally; and a slot 821 is formed between the clamping portion 82, and the rear cover plate 40 or a main body structure of the reinforcer 60 on which the clamping portion 82 is disposed, so that the plug-in piece 81 can be plugged in downwards. Preferably, the plug-in piece 81 takes the shape of S from top to bottom, and is perpendicular to the slot 821, so that a protruding portion of the S-shaped plug-in piece 81 is tightly clamped in the slot 821, which can prevent the plug-in piece 81 from falling off from the slot 821. In addition, the plug-in piece 81 is directly inserted into the slot 821, so that the assembly is simple, easy, and fast.

In summary, the refrigerator in the present invention has the fixing structure 22 bending forwards from the lower end of the rear back plate 21 and the butt-joint structure 42 bending forwards from the top of the rear cover plate 40. The clamping mechanisms 70 matching each other for spacing are disposed on the fixing structure 22 and the butt-joint structure 42. According to the foregoing arrangement, it is ensured that no vertical gap can be formed between the rear back plate 21 of the refrigerator and the upper side of the rear cover plate 40 of the compressor compartment 30, and that the portion where the gap is formed after fixing of the bent position has a low possibility of deforming, so that the refrigerator is more beautiful, the mounting form of the refrigerator is simplified, and the production efficiency is improved.

It should be understood that although the present invention is described in terms of embodiments in the description, not every embodiment includes only one independent technical solution. The statement mode of the description is merely for clarity, and those skilled in the art should regard the description as a whole. The technical solutions in various embodiments may also be combined properly to develop other embodiments that can be understood by those skilled in the art.

The above detailed description only aims to specifically illustrate the available embodiments of the present invention, and is not intended to limit the protection scope of the present invention. Equivalent embodiments or modifications made without departing from the spirit of the present invention shall fall within the protection scope of the present invention.

What is claimed is:

1. A refrigerator, comprising a box body having a rear shell, a compressor compartment disposed below the box body, and a rear cover plate covering a rear side of the compressor compartment, wherein the rear cover plate is adjacently disposed below the rear shell; the rear shell has a rear back plate and a fixing structure formed by bending forwards from a lower end of the rear back plate; the rear cover plate has a cover plate main body and a butt-joint structure formed by bending forwards from a top of the cover plate main body; and the fixing structure and the butt-joint structure are provided with clamping mechanisms that cooperates with each other to limit the position;

wherein the box body has lateral shells disposed on two sides of the compressor compartment and reinforcers fixed with the lateral shells; each reinforcer is disposed on an inner side at a rear end of the lateral shell; and plug-in mechanisms in spacing fit with each other are also disposed between two sides of the rear cover plate and the reinforcer.

2. The refrigerator according to claim 1, wherein an entirety of the fixing structure takes the shape of U having a backward opening; and the butt-joint structure takes the shape of a plate and extends into the U-shaped fixing structure.

3. The refrigerator according to claim 2, wherein the fixing structure has a first wall bending forwards from a lower end of the rear shell, a second wall bending downwards from a front end of the clamping mechanisms, and a third wall bending and extending backwards from a lower end of the second wall; and the clamping mechanisms are disposed between the third wall and the butt-joint structure.

4. The refrigerator according to claim 3, wherein the butt-joint structure is an extending wall extending forwards from a top end of the cover plate main body towards the second wall; the clamping mechanisms are latching pieces respectively formed by tearing the third wall and the extending wall; and the latching piece on the third wall and the latching piece on the extending wall extend towards each other and latch each other.

5. The refrigerator according to claim 1, wherein the clamping mechanisms are a latching convex and a latching groove respectively disposed on the fixing structure and the butt-joint structure; and a side, facing the latching groove, of the latching convex extends slantly from rear to front.

6. The refrigerator according to claim 1, wherein the plug-in mechanism has a plug-in piece disposed on one of the rear cover plate and the reinforcer and a clamping portion disposed on the other one of the rear cover plate and the reinforcer; the plug-in piece is formed via tearing and extends from top to bottom; the clamping portion extends horizontally; and a slot is formed between the clamping portion, and the rear cover plate or a main body structure of the reinforcer on which the clamping portion is disposed, so that the plug-in piece is plugged in downwards.

7. The refrigerator according to claim 6, wherein the plug-in piece is disposed in the shape of S from top to bottom.

8. The refrigerator according to claim 7, wherein the plug-in mechanism is disposed proximal to the rear cover plate and a lower end of the reinforcer.

9. The refrigerator according to claim 6, wherein the plug-in mechanism is disposed proximal to the rear cover plate and a lower end of the reinforcer.

10. The refrigerator according to claim 1, wherein the plug-in mechanism is disposed proximal to the rear cover plate and a lower end of the reinforcer.

11. The refrigerator according to claim 1, wherein several groups of clamping mechanisms are disposed horizontally at intervals, and are all disposed horizontally between the plug-in mechanisms.

* * * * *